US007976333B2

(12) United States Patent
Kroulik

(10) Patent No.: US 7,976,333 B2
(45) Date of Patent: Jul. 12, 2011

(54) LAMINAR ELECTRICAL CONNECTOR

(75) Inventor: Erwin Kroulik, Edmore, MI (US)

(73) Assignee: Flex-Cable, Howard City, MI (US)

( * ) Notice: Subject to any disclaimer, the term of this patent is extended or adjusted under 35 U.S.C. 154(b) by 149 days.

(21) Appl. No.: 12/569,080

(22) Filed: Sep. 29, 2009

(65) Prior Publication Data

US 2011/0076861 A1 Mar. 31, 2011

(51) Int. Cl.
*H01R 11/20* (2006.01)

(52) U.S. Cl. ..... 439/395

(58) Field of Classification Search ..... 439/395, 439/948, 404, 861, 620.03, 622
See application file for complete search history.

(56) References Cited

U.S. PATENT DOCUMENTS

| | | | | |
|---|---|---|---|---|
| 469,566 | A | 2/1892 | Hawthornthwaite | |
| 710,532 | A | 10/1902 | Sprague | |
| 1,181,250 | A | 5/1916 | Renshaw | |
| 1,588,556 | A | 6/1926 | Thompson | |
| 2,074,810 | A | 3/1937 | Sabol | |
| 2,081,047 | A | 5/1937 | Basch | |
| 2,092,505 | A | 9/1937 | Gort | |
| 2,274,422 | A | 2/1942 | Mahoney | |
| 2,462,993 | A | 3/1949 | Peters et al. | |
| 3,941,966 | A * | 3/1976 | Schatz | 219/634 |
| 3,961,832 | A | 6/1976 | Diggs | |
| 4,331,860 | A | 5/1982 | Roller et al. | |
| 4,617,731 | A * | 10/1986 | Carrell et al. | 29/861 |
| 4,648,616 | A * | 3/1987 | Diekman et al. | 280/281.1 |
| 4,650,924 | A | 3/1987 | Kauffman et al. | |
| 4,675,473 | A | 6/1987 | Illakowicz | |
| 4,784,854 | A | 11/1988 | Seguin et al. | |
| 4,787,854 | A | 11/1988 | Le Parquier | |
| 4,829,417 | A | 5/1989 | Morgott et al. | |
| 4,913,662 | A | 4/1990 | Noy | |
| 5,226,840 | A * | 7/1993 | Wojtanek | 439/733.1 |
| 5,373,109 | A | 12/1994 | Argyrakis et al. | |
| 5,393,951 | A * | 2/1995 | Kasper | 219/117.1 |
| 5,486,652 | A | 1/1996 | Kasper | |
| 5,980,302 | A | 11/1999 | Saka | |
| 6,755,240 | B2 * | 6/2004 | Werninger | 165/46 |
| 6,921,301 | B2 * | 7/2005 | Conrad | 439/853 |
| 7,097,491 | B2 * | 8/2006 | Neumann-Henneberg | 439/395 |
| 7,482,540 | B2 | 1/2009 | Shukushima et al. | |
| 2004/0235362 | A1 | 11/2004 | Stigler et al. | |

FOREIGN PATENT DOCUMENTS

EP 0 744 885 A2 11/1996

(Continued)

*Primary Examiner* — T C Patel
*Assistant Examiner* — Phuongchi T Nguyen
(74) *Attorney, Agent, or Firm* — Patent Procurement Services

(57) ABSTRACT

A laminar electrical connector is provided that is formed from multiple superimposed strips of conductive material that form a stack having at least two ends. A second conductive material is used to join adjacent superimposed strips. The resultant connector has ends that are adapted to engage electrical terminals and provide an electrical communication therebetween. The resultant connector lacks a sheath on the ends or a grommet extending through the stack. Such a sheath or grommet limits the operative lifetime of the resulting connector and also creates current focusing that diminishes overall connector efficiency. A connector having a continuous layer of the second conductive material joining adjacent strips along the entire interface between the adjacent strips is also provided and improves connector performance in ways that are especially beneficial to applications associated with an electric vehicle or a hybrid vehicle.

20 Claims, 2 Drawing Sheets

FOREIGN PATENT DOCUMENTS

| | | | |
|---|---|---|---|
| EP | 1 028 489 | A1 | 8/2000 |
| GB | 124320 | | 5/1918 |
| GB | 2115213 | A | 9/1983 |
| SU | 1279837 | A1 | 12/1986 |
| WO | WO 88/02943 | | 4/1988 |

* cited by examiner

LAMINAR ELECTRICAL CONNECTOR

FIELD OF THE INVENTION

The present invention in general relates to an electrical connector and in particular to a laminar electrical connector having improved terminal conductivity and longevity.

BACKGROUND OF THE INVENTION

Electrical connectors have long been made from superimposed plates or strips of conductive metal representative of these articles of those detailed in U.S. Pat. Nos. 710,532; 1,588,556; 2,074,810; and 2,092,505. The common characteristic of these earlier connectors is the inclusion of a sheath or grommet surrounding the hole in the connector, the hole engaging an electrical terminal. Securement of such a connector between two electrically insulated regions allowed these connectors to convey electrical current between the terminals. While prior art connections were well suited for a number of uses, technical innovations associated with electric and hybrid powered vehicles have created performance demands that existing electrical connectors are unable to satisfy. In particular, electrical current concentration around a sheath or grommet produces inefficient electrical transmission, localized heating that changes connector metal temper, and additional material interfaces that are prone to failure. All of these limitations of conventional connectors are made more pronounced by installation in a vehicle where weight considerations, environmental exposure, and vibration are accentuated relative to stationary uses.

Thus, there exists a need for an electrical connector that provides superior performance and ease of manufacture through the exclusion of a sheath or grommet around a connector pole designed to engage an electrical terminal.

SUMMARY OF THE INVENTION

A laminar electrical connector is provided that is formed from multiple superimposed strips of conductive material that form a stack having at least two ends. A second conductive material is used to join adjacent superimposed strips. The resultant connector has ends that are adapted to engage electrical terminals and provide an electrical communication therebetween. The resultant connector lacks a sheath on the ends or a grommet extending through the stack. Such a sheath or grommet limits the operative lifetime of the resulting connector and also creates current focusing that diminishes overall connector efficiency. A connector having a continuous layer of the second conductive material joining adjacent strips along the entire interface between the adjacent strips is also provided and improves connector performance in ways that are especially beneficial to applications associated with an electric vehicle or a hybrid vehicle.

A process for manufacturing a laminar electrical connector stack includes superimposing strips of a first conductive material having a first material melting temperature to form a stack. A layer of second conductive material having second conductive material melting temperature less than the first conductive material melting temperature is placed between adjacent superimposed strips. Resistive heating of the stack to a temperature greater than two thirds of the second material melting temperature and less than the first conductive material melting temperature increases electrical conductivity and delamination strength of the stack in a direction transverse to the stack.

DETAILED DESCRIPTION OF THE PREFERRED EMBODIMENTS

The present invention has utility as an electrical connector. An inventive connector is particularly well-suited to operate in an environment associated with an electric or hybrid vehicle. Particularly beneficial features of an inventive connector include exclusion of a sheath or grommet surrounding a connector engagement with an extrinsic electrical terminal so as to limit current focusing and mechanical failure associated with the additional sheath or grommet. Additionally, an inventive connector includes layers of a lower melting temperature material relative to the strip material to improve performance of the resultant connector and provide a manufacturing scheme that does not rely on dipping connector ends into molten solder.

Figure 1:
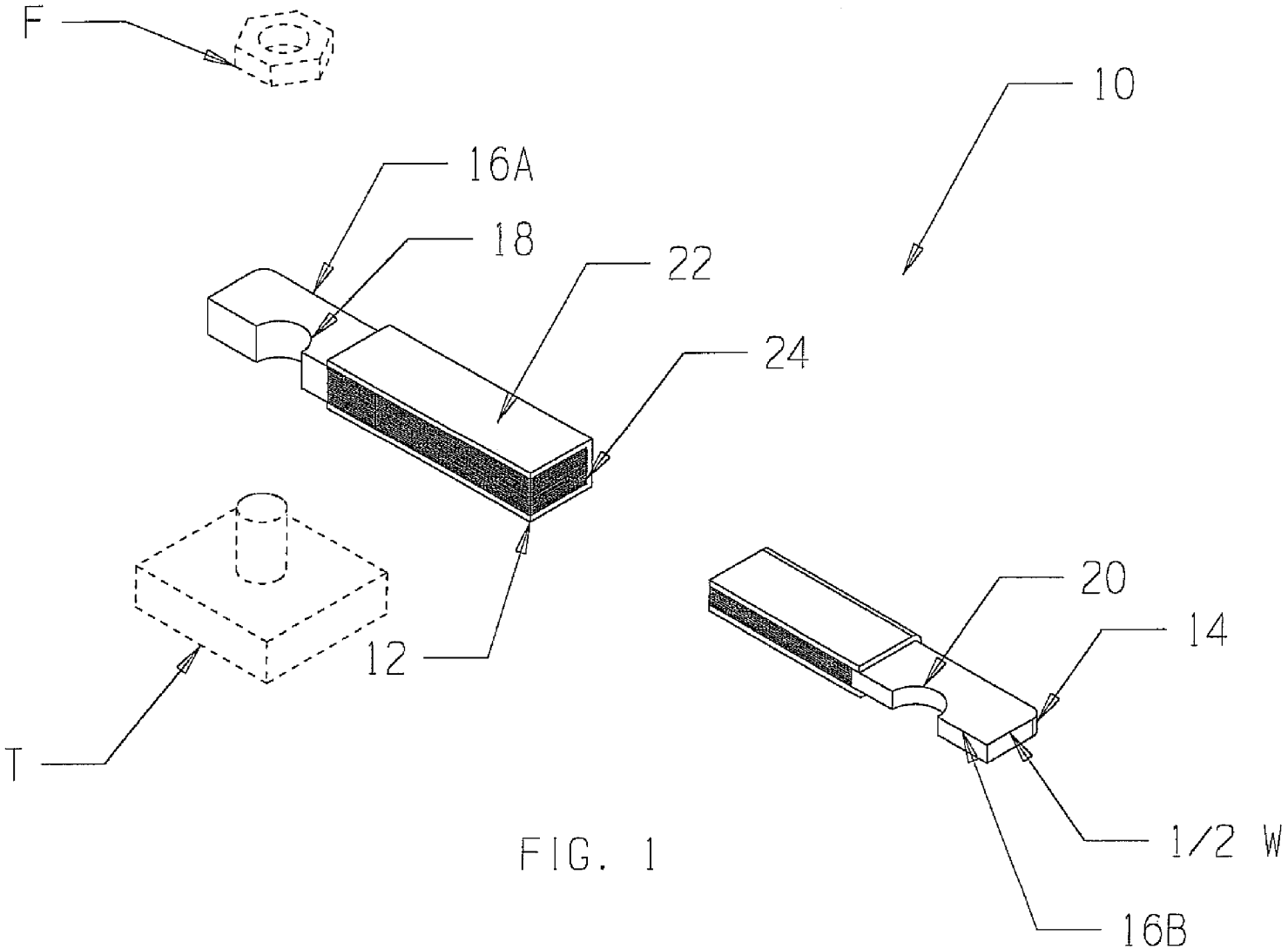
FIG. 1 is a simultaneous longitudinal and transverse cross-sectional view of an inventive dual end laminar electrical connector.

The inventive electrical connector is shown generally at 10 in FIG. 1. The connector 10 is formed from multiple conductive material strips 12 that are superimposed to form a stack 14. The connector 10 has ends at 16A and 16B. The ends 16A and 16B are each adapted to engage an extrinsic electrical terminal T to provide an electrical conduction path therebetween. It is appreciated that end 16A or 16B is amenable to functioning as an electrical contact with an electrical terminal T through a clamp that engages a stack 14. Superior current flow characteristics are obtained in the end portion 16A or 16B, preferably, through formation of a hole 18 or notch 20 through the stack 14. The hole 18 or notch 20 is adapted to engage an electrical terminal T or otherwise form a high surface area electrical contact with the electrical terminal T through insertion of a fastener F or other conventional component to the hole 18 or notch 20, and into electrical communication with the electrical terminal T. It is appreciated that the presence, dimensions, and shape of a hole 18 or notch 20 in one end of an inventive connector 10 is wholly independent from those present in another end of the connector 10. By way of example, a hole is circular, oblong or of a polygonal cross-sectional shape. The surface portions of the stack 14 intermediate between ends 16A and 16B are preferably covered with a polymeric electrical insulator. Polymeric electrical insulators 22 operative herein illustratively include Thermoplastic elastomers (TPE), Thermoplastic vulcanizates (TPV), poly vinyl chloride (PVC), Polytetrafluoroethylene, silicone, polyolefin, neoprene, and varnish. An inventive electrical conductor 10 is without a sheath surrounding the end portion 16 of stack 14 and also without a grommet, rivet, or ferrule surrounding a hole 18 or notch 20 formed in end 16A or 16B.

A strip 12 used to form the stack 14 is chosen on a basis of electrical conductivity properties as well as operational longevity in the environment in which a given inventive electrical connector 10 is applied. Representative material suitable for the formation of a conductive strip 12 illustratively include copper, aluminum, iron, silver, and alloys thereof; steel; intermetallics; superconductors; pnictides, alloys thereof, and laminate thereof. Copper and copper alloys represent preferred compositions for a strip 12. More preferably, half hard and spring tempered copper and copper alloys used to form a strip 12, and in particular for a connector 10 operative in a vehicle application. To form a stack 14 multiple metal strips 12 are superimposed with complimentary contours so as to provide as a preferred embodiment to a stack 14 with limited voids between each of the strips 12 therein.

A stack 14 of superimposed metal strips 12 are readily joined into a unified body both structurally and electrically by conventional techniques illustratively including: dipping an end into a molten solder with the solder having a lower melting temperature than the superimposed conductive strips 12 material; heating an end 16A or 16B to a temperature sufficient to fuse various strips 12 together through techniques, such as induction welding; and dipping an end 16A or 16B into a conductive paint to intercalate conductive particulate, such as carbon black or metallic flake into the interstitial planes between adjacent strips 12 and an adjoining strip. While these conventional techniques are operative to form an inventive electrical connector 10, to conventional techniques has been found to limit overall connector performance. By way of example, solder dipping provides incomplete wetting, produces a stack with internal compressive stress, creates concentrated points of concurrent flow, leaves voids within the stack 14 and portions thereof that are not dipped into the solder bath. The other techniques of strip fusion and conductive paint application also suffer similar limitations.

In order to provide a higher performance electrical connector, a second conductive material 24 is provided as a layer sandwiched between adjacent superimposed strips 12. The second conductive material 24 preferably covers the majority of the surface interface between adjacent conducting strips 12. More preferably, all of the surface interface is so covered by material 24. The second conductive material 24 is chosen to have a melt temperature less than that of the conductive strip 12 such that upon heating a stack 14 having conductive material 24 sandwiched along the interface between two superimposed strips 12 to a temperature between the annealing temperature and just above melting temperature of the conductive material 24, the stack 14 is physically and electrically joined through the thickness, t of the stack 14. As used herein, the annealing temperature is defined as two thirds of the melt temperature for the second conductive material 24, in degrees Kelvin.

It is appreciated that a conductive material 24 is readily applied as a surface coating onto a sheet of material from which a strip 12 is formed. Alternatively, second conductive material 24 is applied as a powder, plating, or a dip coating on a strip 12. Such a coating is also optionally applied to both opposing surfaces of a strip 12 such that the interface between superimposed strips 12 has a layering: (conductive strip material-second conductive material)/(second conductive material-conductive strip material). The use of dual surface coated strips with both strip surfaces surface being coated with conductive material are especially preferred since contact formation then involves like materials of second conductive material 24 becoming physically joined together and at a temperature that does not change the temper of the conductive strip material. In instances when the strips 12 are copper or copper alloys; tin, tin-based alloys, bismuth, and bismuth-based alloys represent preferred second conductive materials 24. It is appreciated that the second conductive material 24 is formed of any of the material from which a strip 12 is formed with the proviso that the second conductive material 24 has a melt temperature below that of the conductive strip material.

In a preferred process of forming inventive conductor 10, a stack of superimposed conductive material strips 12 and the interface between adjacent superimposed strips including a second conductive material layer 24 are aligned and fixtured. An electrical current is applied to the fixtured stack so as to resistively heat the stack 14 to a temperature of between the annealing temperature and just above the melt temperature of the second conductive material 24. Upon reduction of current input to the stack 14, the second conductive material 24 hardens to form a joined stack 14, with high strength and high conductivity relative to conventional joining techniques. It is appreciated that by controlling the current, the thermal profile of stack joining is controlled to mitigate interfacial stresses and control defect formation.

An inventive connector 10 is formed from superimposing at least two strips 12. Typically, between 2 and 50 strips 12 are superimposed. Preferably, between 2 and 20 strips 12 are superimposed to form a stack 14. It is appreciated that a strip 12 need not have the same elemental composition as another strip 12 within the same stack 14.

An inventive connector well suited for electrically joining a vehicle battery with the components of an electrical or hybrid vehicle includes copper as the majority composition of the stack 14. A stack 14 for a vehicle applications typically has a thickness, t of between 0.5 and 4 millimeters and a width, w of typically between 10 and 40 millimeters and has a current carrying capacity of a 8 to 0000 American Wire Gauge (AWG) standard circular cross section copper wire.

Figure 2:
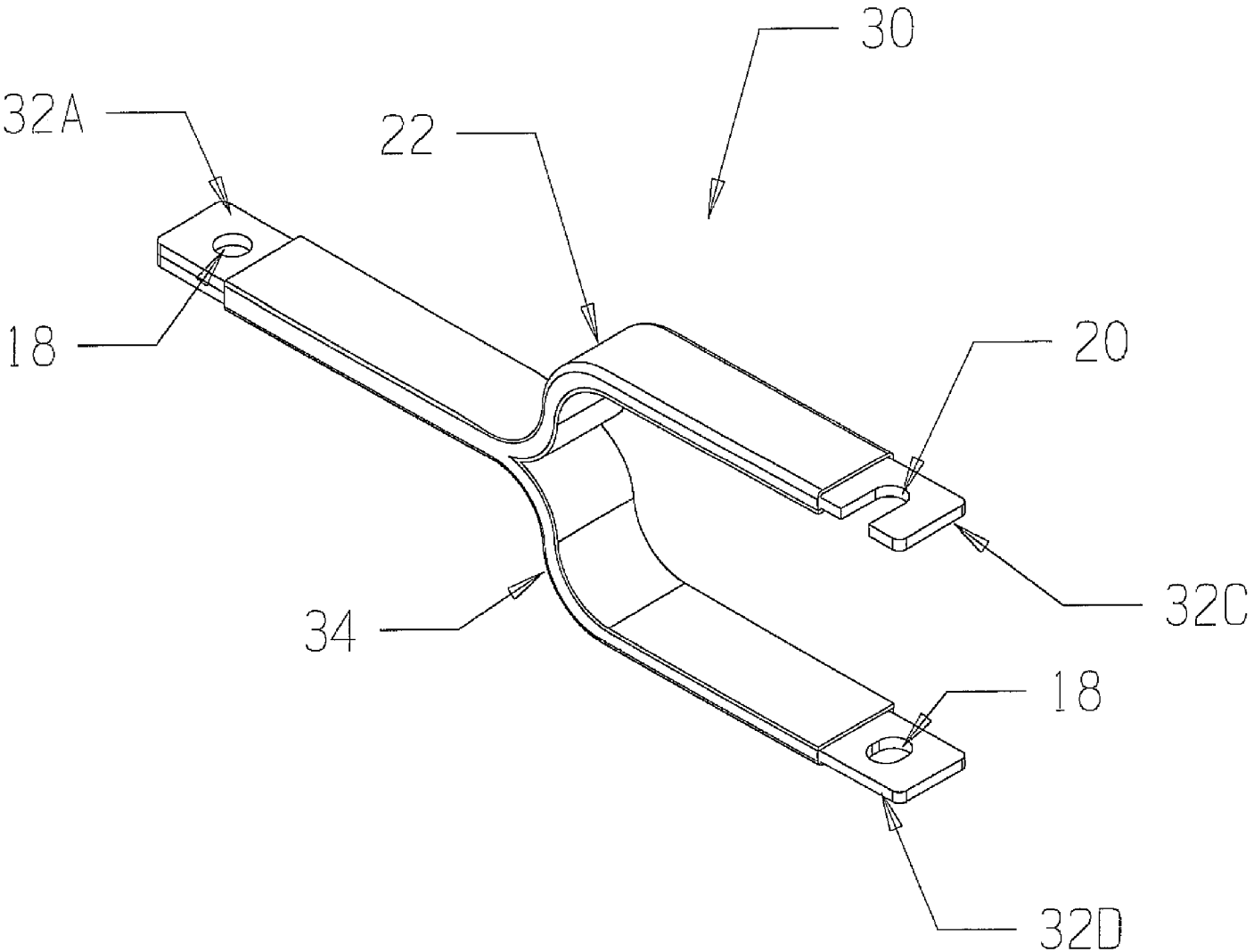
FIG. 2 is a perspective view of an inventive multiple ended laminar electrical connector.

Referring now to FIG. 2 where like numerals correspond to the meaning ascribed to those numerals with respect to FIG. 1, a multiple-ended inventive conductor is shown generally at 30. The connector 30 is formed from superimposed conductive strips that form a stack as detailed above with respect to FIG. 1. The strips used to form the connector 30 are stamped from a sheet and superimposed as detailed above with respect to FIG. 1. Connector 30 is noted to have three ends 32A, 32C, and 32D. End 32A has a circular hole 18 and 32D has an oblong hole 18 therethrough. End 32C includes a notch 20. Connector 30 has ends of lesser thickness at 32C and 32D relative to end 32A and is particularly well suited for current splitting to electrical terminals joined to ends 32C and 32D that require less current-carrying capacity. Bend regions 34 of electrical connector 30 are readily created any time during the process of electrical connector formation including stamping such contours into the strips, bending a joined stack or bending a joined stack already covered with polymeric insulator 22.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The foregoing description is illustrative of particular embodiments of the invention, but is not meant to be a limitation upon the practice thereof. The following claims, including all equivalents thereof, are intended to define the scope of the invention.

The invention claimed is:

1. A laminar electrical connector comprising:

a plurality of superimposed strips of a first conductive material having a first material melting temperature and forming a stack having at least two ends, each of the at least two ends adapted to engage electrical terminal; and a second conductive material joining two adjacent strips of said plurality of superimposed strips with a proviso that the at least two ends are not covered by a sheath or has a grommet therethrough, said second conductive material having a second conductive material melting temperature less than the first conductive material melting temperature positioned between adjacent strips of said plurality of superimposed strips, said second conductive material and said two adjacent strips of said plurality of superimposed strips have been heated to a temperature greater than two thirds of the second material melting temperature and less than the first material melting temperature to increase electrical conductivity and delamination strength in a direction transverse to said stack.

2. The connection of claim 1 wherein said plurality of superimposed strips as between 2 and 20 strips.

3. The connector of claim 1 wherein one of the at least two ends has a hole or a notch extending through said stack.

4. The connector of claim 1 wherein the at least two ends are two ends.

5. The connector of claim 1 further comprising a polymeric insulator enveloping portion of said stack between the at least two ends.

6. The connector claim 1 wherein said plurality of superimposed strips comprises strips formed of aluminum or aluminum alloys.

7. The connector of claim 1 wherein said second conductive material forms a continuous interface between two adjacent strips of said plurality of superimposed strips.

8. The connector of claim 7 wherein said plurality of superimposed conductive strips are copper or copper alloys and said second conductive material is tin, a tin-based alloy, bismuth or a bismuth-based alloy.

9. The connector of claim 1 wherein said plurality of superimposed strips are formed of copper or a copper alloy and said second conductive material is tin or, a tin-based alloy and said stack has current carrying capacity of a 8 to 0000 American Wire Gauge (AWG) standard circular cross section copper wire.

10. The connector of claim 9 wherein the electrical terminal is a battery within an electric vehicle or a hybrid vehicle.

11. The connector claim 1 wherein said plurality of superimposed strips comprises strips formed of copper or copper alloys.

12. The connector of claim 11 wherein a said copper or copper alloys are half hard or spring tempered.

13. The connector of claim 11 wherein said second conductive material is tin or a tin-based alloy.

14. A laminar electrical connector comprising:

a plurality of superimposed strips of a first conductive material having a first material melting temperature and forming a stack having at least two ends, each of the at least two ends adapted to engage electrical terminal; and second conductive material forming a continuous interface between two adjacent strips of said plurality of superimposed strips with a proviso that the at least two ends are not covered by a sheath, said second conductive material having a second conductive material melting temperature less than the first conductive material melting temperature positioned between adjacent strips of said plurality of superimposed strips, said second conductive material and said two adjacent strips of said plurality of superimposed strips have been heated to a temperature greater than two thirds of the second material melting temperature and less than the first material melting temperature to increase electrical conductivity and delamination strength in as direction transverse to said stack.

15. The connector of claim 14 wherein said plurality of superimposed conductive strips are copper or copper alloys and said second conductive material is tin, a tin-based alloy, bismuth, or a bismuth-based alloy.

16. The connector of claim 14 wherein said plurality of superimposed strips are formed of copper or a copper alloy and said second conductive material is tin or a tin-based alloy and said stack has current carrying capacity of a 8 to 0000 American Wire Gauge (AWG) standard circular cross section copper wire.

17. The connector of claim 14 wherein the electrical terminal is a battery within an electric vehicle or a hybrid vehicle.

18. The connector claim 14 wherein said plurality of superimposed strips comprises strips formed of aluminum or aluminum alloys.

19. The process for manufacturing a laminar electrical connector comprising:

superimposing a plurality of strips of a first conductive material having a first material melting temperature to form a stack having at least two ends;

layering a second conductive material haying a second conductive material melting temperature less than the first conductive material melting temperature between adjacent strips of said plurality of superimposed strips with a proviso that the at least two ends are not covered by a sheath; and heating said stack to a temperature greater than two thirds of the second material melting temperature and less than the first material melting temperature to increase electrical conductivity and delamination strength of said stack in a direction transverse to said stack.

20. The process of claim 19 further comprising forming a hole or a notch through said stack in the transverse direction.

* * * * *